US008228258B2

(12) United States Patent
Montgomery

(10) Patent No.: US 8,228,258 B2
(45) Date of Patent: Jul. 24, 2012

(54) MULTI-PORT ANTENNA

(75) Inventor: Mark T. Montgomery, Melbourne Beach, FL (US)

(73) Assignee: SkyCross, Inc., Viera, FL (US)

( * ) Notice: Subject to any disclaimer, the term of this patent is extended or adjusted under 35 U.S.C. 154(b) by 412 days.

(21) Appl. No.: 12/644,691

(22) Filed: Dec. 22, 2009

(65) Prior Publication Data

US 2010/0156747 A1 Jun. 24, 2010

Related U.S. Application Data

(60) Provisional application No. 61/140,370, filed on Dec. 23, 2008.

(51) Int. Cl.
*H01Q 1/50* (2006.01)

(52) U.S. Cl. ..... 343/860; 343/795

(58) Field of Classification Search ..... 343/795, 343/844, 860

See application file for complete search history.

(56) References Cited

U.S. PATENT DOCUMENTS

| | | | | |
|---|---|---|---|---|
| 6,313,809 | B1 | 11/2001 | Gabriel et al. | |
| 6,888,510 | B2 * | 5/2005 | Jo et al. | 343/797 |
| 7,265,718 | B2 * | 9/2007 | Tsai | 343/700 MS |
| 2004/0140942 | A1 | 7/2004 | Gottl | |
| 2007/0164906 | A1 * | 7/2007 | Tsai | 343/700 MS |
| 2008/0024378 | A1 * | 1/2008 | Kanno et al. | 343/770 |
| 2008/0143613 | A1 | 6/2008 | Iwai et al. | |
| 2008/0174508 | A1 | 7/2008 | Iwai et al. | |
| 2010/0007572 | A1 * | 1/2010 | Jones et al. | 343/798 |

FOREIGN PATENT DOCUMENTS

| | | | |
|---|---|---|---|
| KR | 10-2006-0099601 | | 9/2006 |
| WO | WO-2004-100315 | A1 | 11/2004 |
| WO | WO-2008-131157 | A1 | 10/2008 |

OTHER PUBLICATIONS

International Search Report and Written Opinion for PCT/US2009/069225 dated Jul. 1, 2010.

International Search Report and Written Opinion for PCT/US2009/069233 dated Jun. 30, 2010.

Famdie et al., "Numerical Analysis of Characteristic Modes on the Chassis of Mobile Phones" Antennas and Propagation, 2006, EuCAP 2006.

* cited by examiner

*Primary Examiner* — Tan Ho

(74) *Attorney, Agent, or Firm* — Rajesh Vallabh; Foley Hoag LLP

(57) ABSTRACT

A multi-port antenna structure includes a plurality of electrically conductive elements arranged generally symmetrically about a central axis with a gap between adjacent electrically conductive elements. Each of the electrically conductive elements has opposite ends and a bent middle portion therebetween, with the bent middle portion being closer to the central axis than the opposite ends. Each of the electrically conductive elements is configured to have an electrical length selected to provide generally optimal operation within one or more selected frequency ranges. Each of a plurality of antenna ports is connected to adjacent electrically conductive elements across the gap therebetween such that each antenna port is generally electrically isolated from another antenna port at a given desired signal frequency range and the antenna structure generates diverse antenna patterns.

20 Claims, 14 Drawing Sheets

MULTI-PORT ANTENNA

CROSS REFERENCE TO RELATED APPLICATION

This application claims priority from U.S. Provisional Patent Application Ser. No. 61/140,370 filed on Dec. 23, 2008 and entitled Planar Three-Port Antenna and Dual Feed Antenna, which is hereby incorporated by reference.

BACKGROUND

The present application relates generally to wireless communications devices and, more particularly, to antennas used in such devices.

Many communications devices require multiple antennas that are located in close proximity (e.g., less than a quarter of a wavelength apart) and that can operate simultaneously within the same frequency band. Common examples of such communications devices include communications products such as wireless access points and femtocells. Many communications system architectures (such as Multiple Input Multiple Output (MIMO), and diversity) that include standard protocols for mobile wireless communications devices (such as 802.11n for wireless LAN, and 3G data communications such as 802.16e (WiMAX), HSDPA, and 1×EVDO) require multiple antennas operating simultaneously.

BRIEF SUMMARY OF EMBODIMENTS OF THE INVENTION

A multi-port antenna structure in accordance with one or more embodiments of the invention includes a plurality of electrically conductive elements arranged generally symmetrically about a central axis with a gap between adjacent electrically conductive elements. Each of the electrically conductive elements has opposite ends and a bent middle portion therebetween, with the bent middle portion being closer to the central axis than the opposite ends. Each of the electrically conductive elements is configured to have an electrical length selected to provide generally optimal operation within one or more selected frequency ranges. Each of a plurality of antenna ports is connected to adjacent electrically conductive elements across the gap therebetween such that each antenna port is generally electrically isolated from another antenna port at a given desired signal frequency range and the antenna structure generates diverse antenna patterns.

Various embodiments of the invention are provided in the following detailed description. As will be realized, the invention is capable of other and different embodiments, and its several details may be capable of modifications in various respects, all without departing from the invention. Accordingly, the drawings and description are to be regarded as illustrative in nature and not in a restrictive or limiting sense, with the scope of the application being indicated in the claims.

DETAILED DESCRIPTION

Many wireless communications protocols require use of multiple wireless channels in the same frequency band either to increase the information throughput or to increase the range or reliability of the wireless link. Implementation of systems using these protocols consequently requires the use of multiple independent antennas. In modern wireless devices, such as Mobile Phones, Smart Phones, PDAs, Mobile Internet Devices, and Wireless Routers, it is generally desirable to place the antennas as close together as possible to generally minimize the size of the antenna system. However, placing antennas in close proximity can lead to undesirable effects of direct coupling between antenna ports and diminished independence, or increased correlation, between the radiation patterns of the antennas.

Figure 1:
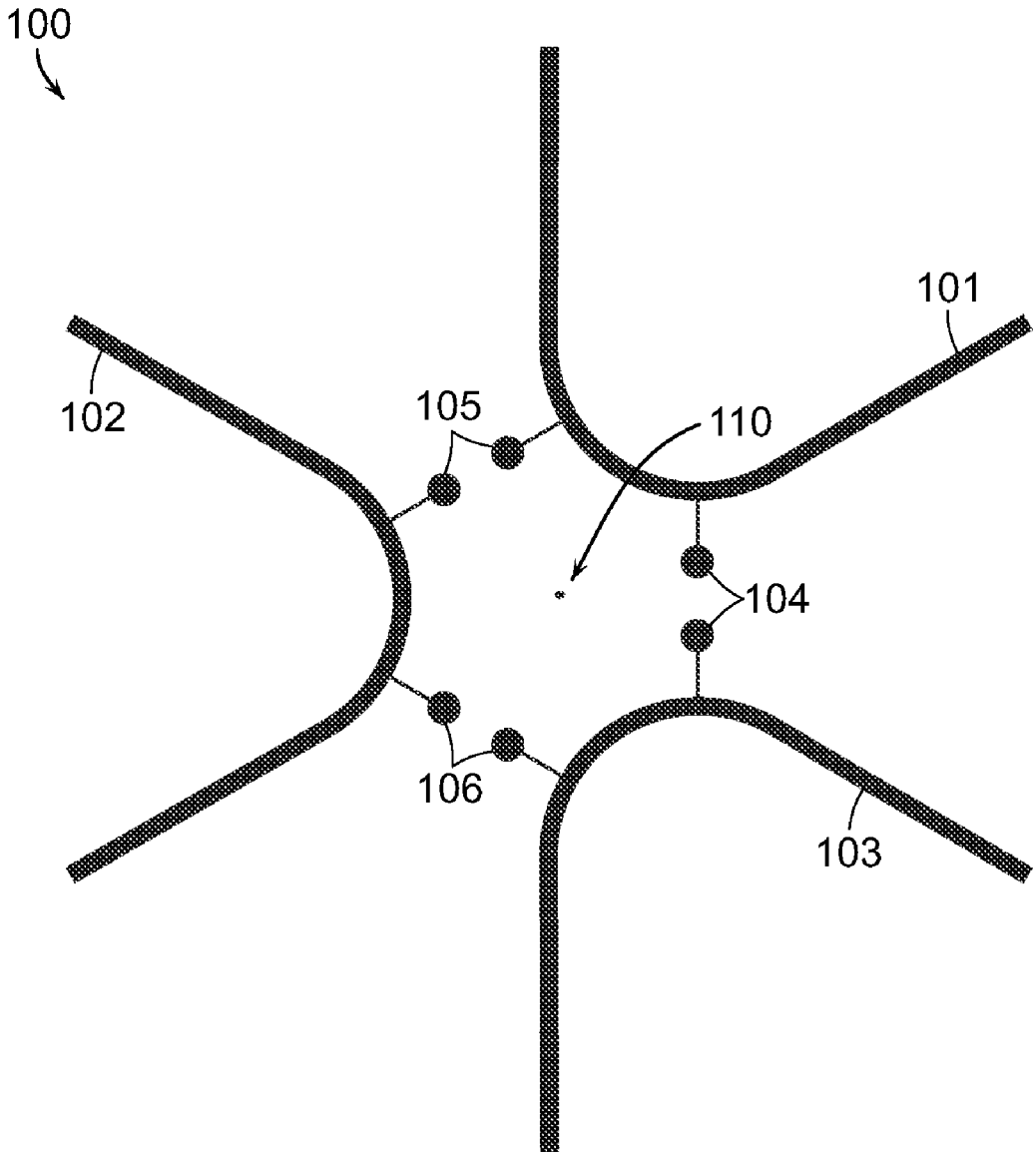
FIG. 1 is a schematic illustration of an exemplary planar three port antenna in accordance with one or more embodiments of the invention.

In accordance with one or more embodiments of the invention, an antenna structure with multiple antenna ports is provided to achieve compact size, while generally maintaining isolation and antenna independence between ports. An antenna structure 100 in accordance with one or more embodiments is shown diagrammatically in FIG. 1. The antenna structure 100 includes three conductive elements 101, 102, and 103, each with an electrical length of nominally one half of the wavelength at the desired frequency of operation. The elements 101, 102, and 103 all lie within a single geometric plane and lie about a common axis of symmetry 110 that is normal to the plane. Each element 101, 102, and 103 includes opposite ends and a bent middle portion therebetween. The middle portion of each element 101, 102, and 103 is closer to the axis of symmetry 110, while the ends extend away from the axis. Antenna ports 104, 105, and 106 are positioned across the gaps between adjacent elements 101, 102, and 103.

Excitation of the antenna 100 by applying a signal at one of the ports 104, 105, and 106 will evidence a resonant condition with currents flowing on each of the elements 101, 102, and 103. The attachment of ports 104, 105, and 106 between adjacent elements 101, 102, and 103 however allows for currents to flow on each of the elements 101, 102, and 103 without passing through the ports, thereby allowing for the ports 104, 105, and 106 to remain generally isolated from each other. The degree of isolation is a function of the location of the ports and the coupling between the conductive elements. The coupling is controlled by the distance between the elements, in particular how close the ends of the conductive elements are to each other. If an element is bent with the ends being close to one another, the coupling to itself is greater, while coupling to a neighboring element is decreased. Conversely, if the elements are bent to form a wide angle between the element ends, then the coupling to adjacent elements is increased.

The input impedance of the antenna is also a function of the geometry and, therefore a particular design may involve a tradeoff between geometry best for isolation and best for a desired input impedance, e.g., 50 ohms. Matching components also may be added to transform the input impedance with some independence from the isolation. Antenna elements with a planar width as opposed to thin wire shapes are generally advantageous for obtaining larger antenna bandwidths and smaller parasitic losses.

Good isolation and impedance match to 50 ohms are generally obtainable at frequencies near to that corresponding to the half-wavelength resonant frequency of the conductive elements. Multiple operational frequency bands may be obtained by using conductive elements with multiple half-wavelength frequencies. One method of doing this is to split the elements such that they have multiple branches, with the length of each branch corresponding to a different half-wavelength resonant frequency. In the case of single or multiple frequencies, the physical size of the antenna may be reduced by loading the elements to increase their electrical length. Two common methods of loading are to increase the path length by meandering or winding the conductors (making the path tortuous) or placing the antenna on or within high dielectric materials.

Each antenna port is defined by the location of two terminals on either side of the gap between adjacent conductive elements. The port locations may be extended to another location by use of a suitable transmission line. One example of this is to attach a coaxial cable at the port location by connecting the shield portion to one terminal and the center conductor to the other terminal. The cable provides an extension of the port to the desired point of connection such as radio circuitry. A more optimal solution may use a balanced transmission line or a balun structure to reduce the effects of the transmission line on the antenna.

Figure 2A:
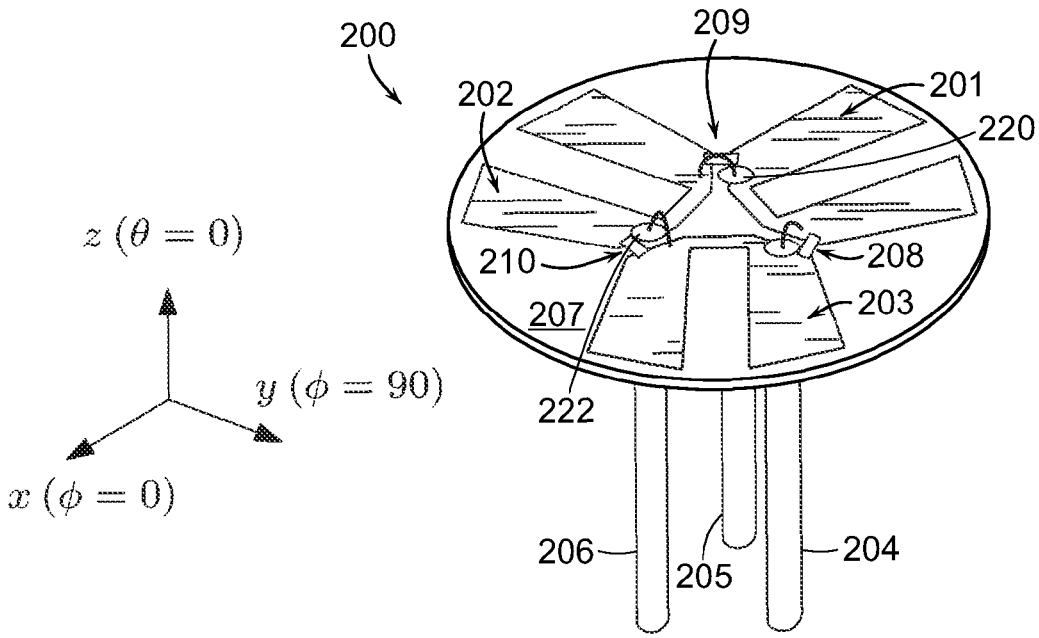
FIG. 2A is a perspective view of an exemplary single-band planar three-port antenna manufactured on a printed circuit substrate in accordance with one or more embodiments of the invention.
Figure 2B:
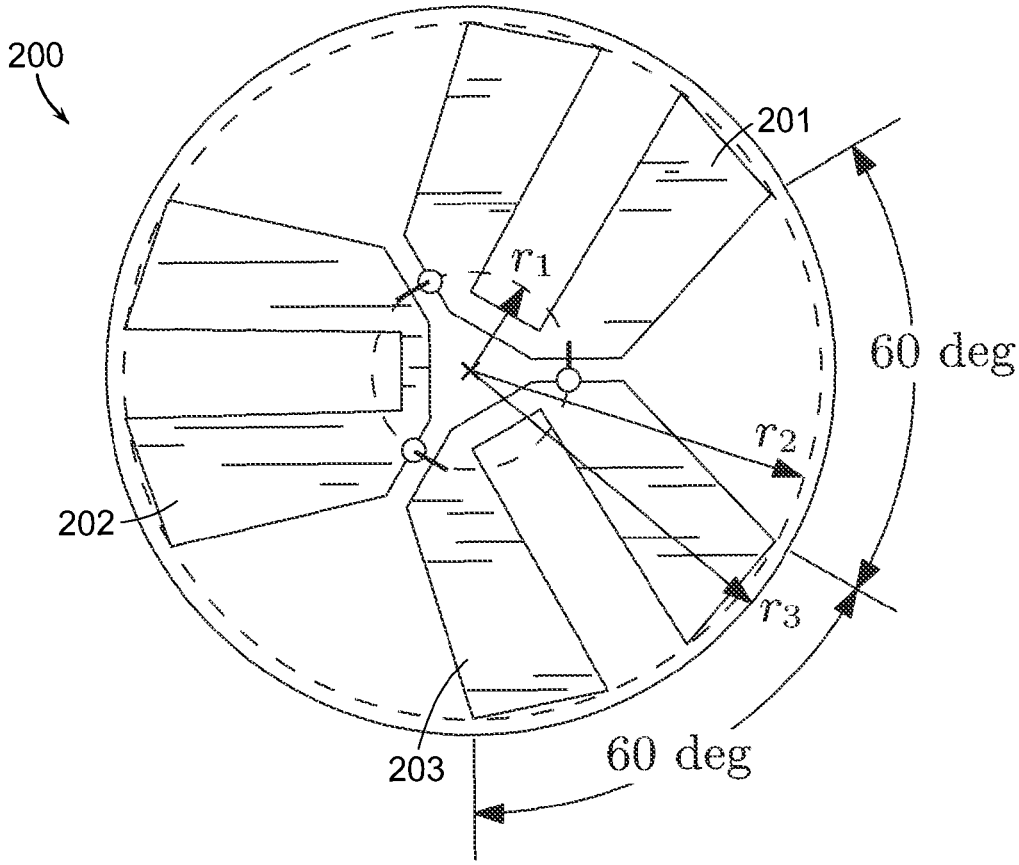
FIG. 2B is a top plan view of the antenna of FIG. 2A.

One example of an antenna designed to operate in a single frequency band is shown on FIGS. 2A and 2B. The antenna structure 200 includes a dielectric substrate 207 with three generally identical conductive elements 201, 202, and 203, etched from a single copper layer, three coaxial cables 204, 205, and 206, and three discrete matching inductors 208, 209, and 210 or impedance matching networks. The substrate in this example is a circular disk 1-mm thick and 23-mm radius cut from FR408 material manufactured by Rogers Corporation. The copper elements 201, 202, and 203 are arranged symmetrically about a common center axis such that the ends of the elements fall on a circle of radius 22 mm and the angle between outer points subtends 60 degrees. At this outer radius, the parts are also separated by 60 degrees of arc (approximately 23 mm).

Towards the center of the antenna structure 200, the space between the adjacent elements 201, 202, and 203 diminishes to a gap width of 1 mm. The coaxial cables 204, 205, and 206, are attached across the 1-mm gaps at a radial distance of 9 mm from the center. Each cable passes through a hole 220 on one side of the gap (where the cable shield is soldered) to the adjacent copper element. The center conductor 222 of each cable is bent across the gap and soldered to the adjacent copper element on the other side of the gap. The matching inductors 208, 209, and 210 are soldered across the gaps next to the feed at a radial distance of 10 mm from the center. Each inductor is a wire-wound 0402 chip inductor with nominal value of 4.7 nH.

The performance of the antenna 200 of FIG. 2 was simulated using Ansoft HFSS and also measure for a prototype assembly. The simulated return loss (S11) and coupling (S12) are provided on FIGS. 3A and 3B. Note that for the simulation, the geometry has perfect symmetry, and therefore all the reflection terms are the same as S11 and the coupling terms match S12.

Figure 3A:
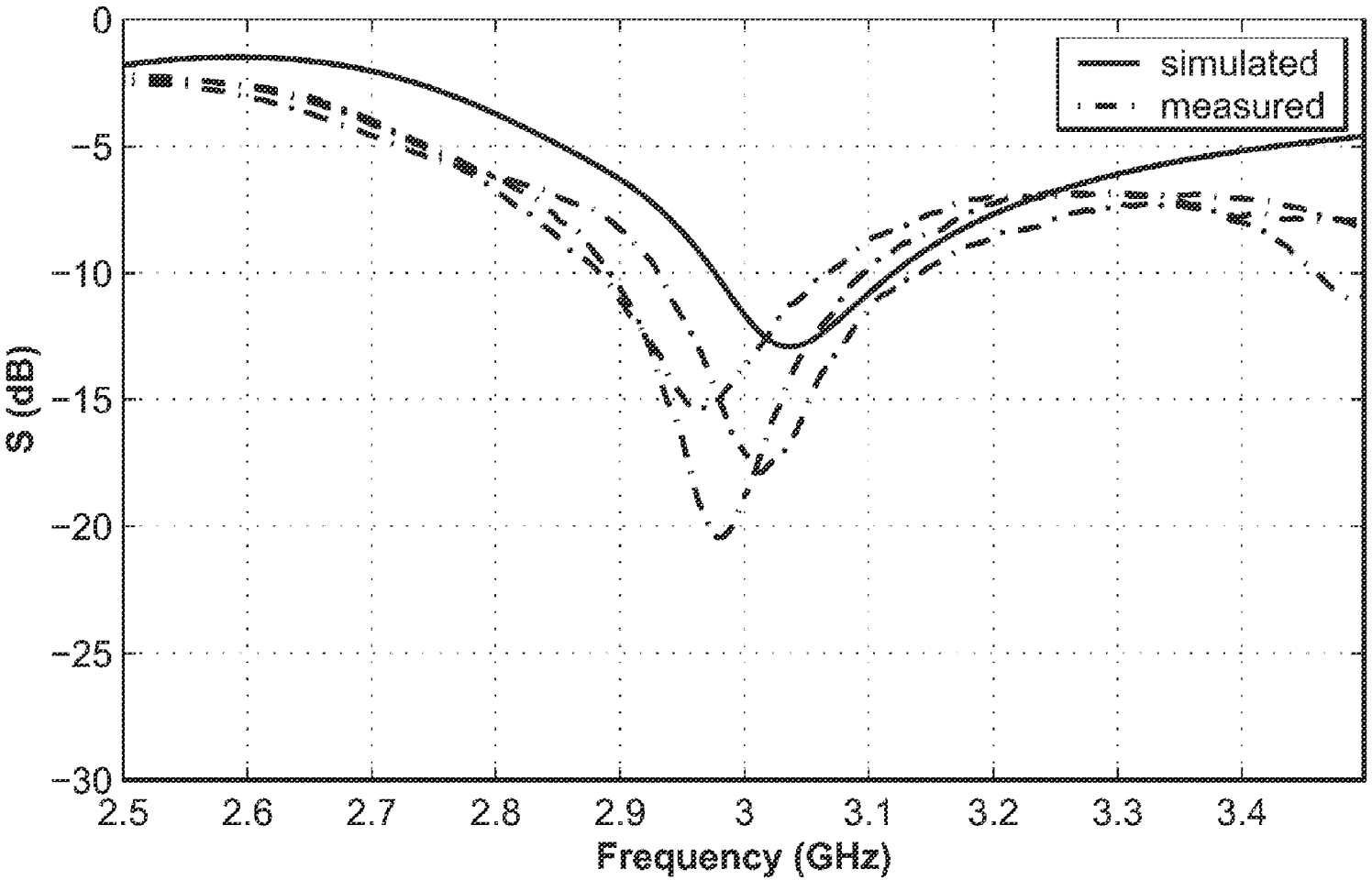
FIG. 3A is a graph illustrating the return loss (S11) of the antenna of FIG. 2.
Figure 3B:
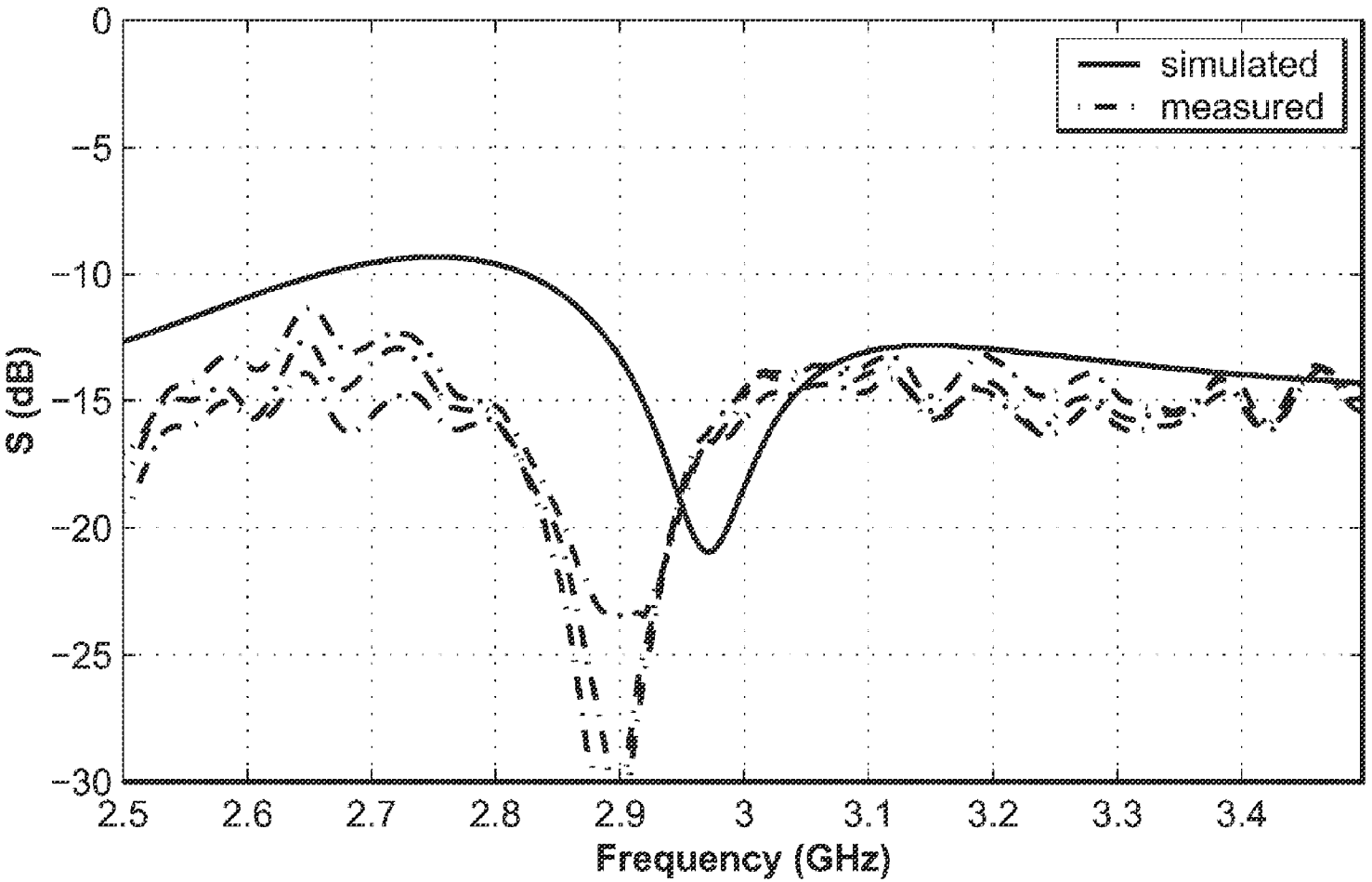
FIG. 3B is a graph illustrating the port to port coupling (S12) for the antenna of FIG. 2.

Measurements of the scattering parameters for the antenna 200 are also shown on FIGS. 3A and 3B. In the case of the measured data, three plots are shown, one for each port. The differences in the measured plots are due to variations in the prototype from the design and the repeatability of the measurement. The shape of the measured frequency response is in agreement with that predicted by the simulation, but is shifted about 70 MHz (2.3%) lower.

Figure 3C:
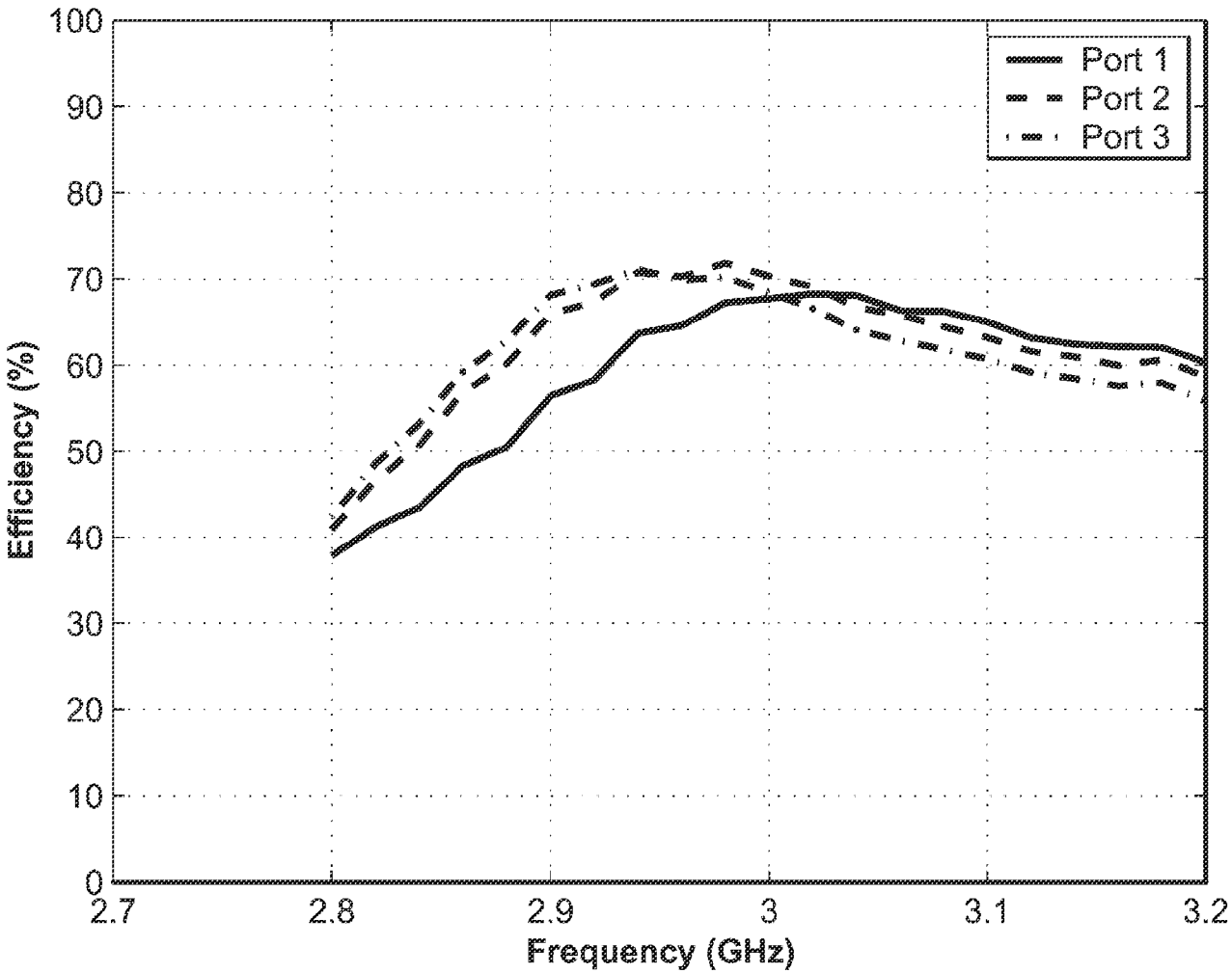
FIG. 3C is a graph illustrating the of the radiation efficiency for antenna of FIG. 2.
Figure 3D:
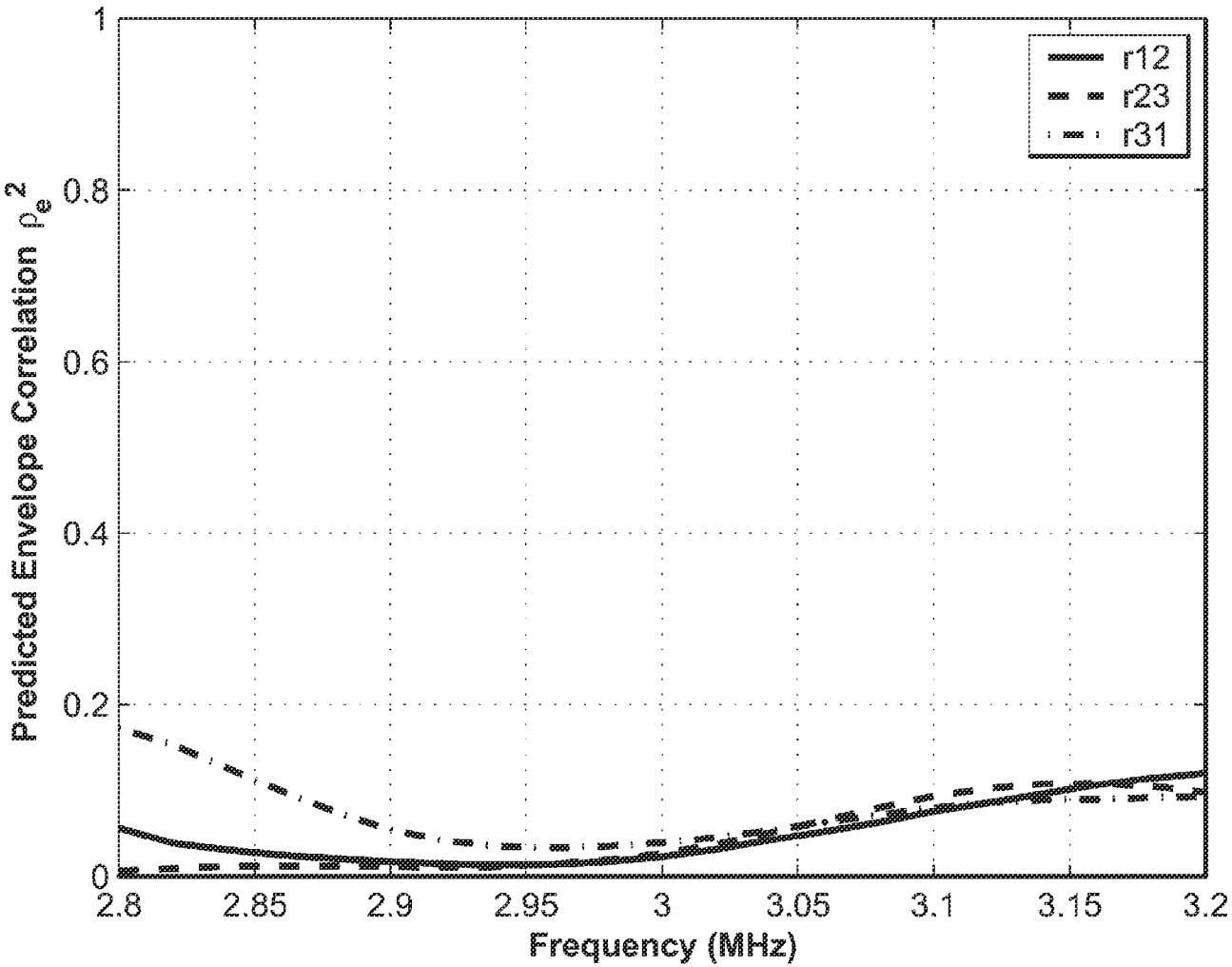
FIG. 3D is a graph illustrating the square of the pattern correlation coefficients for the antenna of FIG. 2.
Figure 3E:
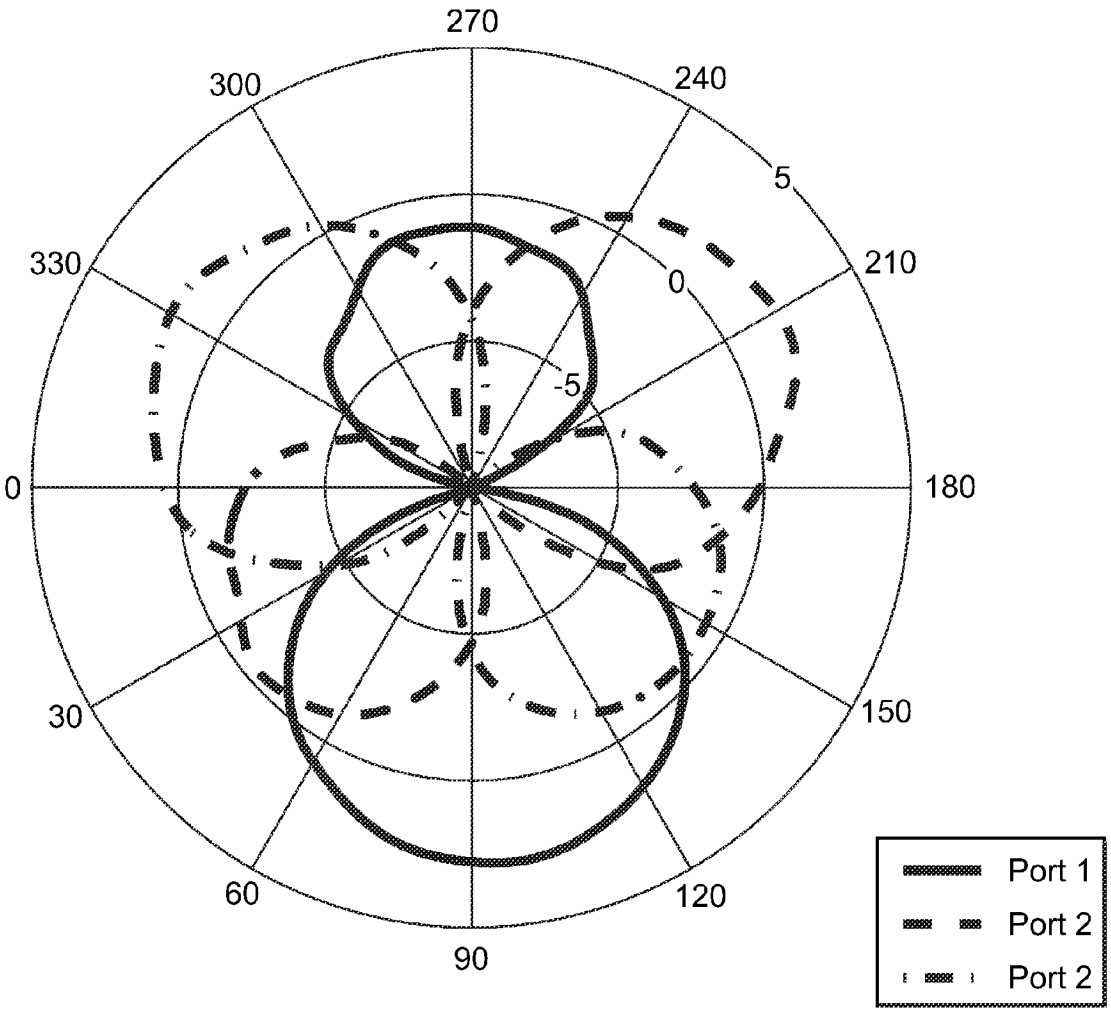
FIG. 3E is a graph illustrating the azimuthal gain plots for the antenna of FIG. 2.

The measured gain patterns on the azimuth plane at a frequency of 3 GHz are provided in FIG. 3E. Each of the ports produces a radiation similar to that of a dipole lying in the horizontal plane (i.e., the plane of the antenna). For reference, the attachments to cables 204, 205, and 206 are referred to as Ports 1, 2, and 3, respectively. The pattern produced from excitation of Port 1 is similar to a dipole on the x-axis. By symmetry, the other two ports will produce generally the same pattern, but rotated 120 or 240 degrees about the z-axis. These plots exhibit the angular orientation of each pattern. The correlation between the patterns produced by any two ports is low as shown on FIG. 3D. The measured realized efficiency is about 70 percent as shown on FIG. 3C.

Figure 4:
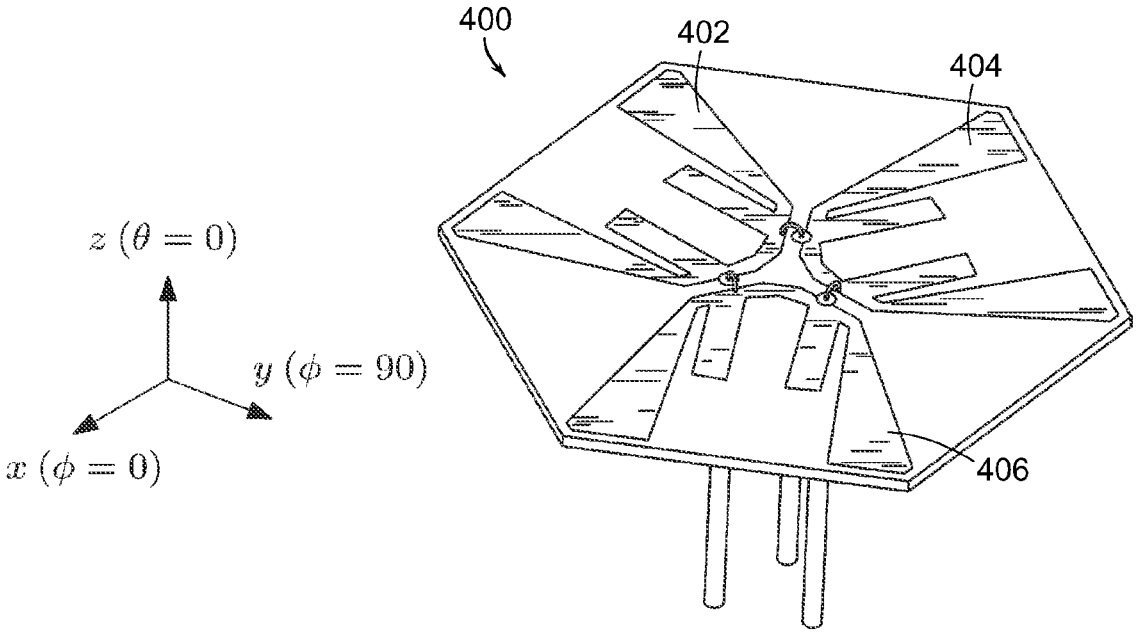
FIG. 4 is a perspective view of an exemplary dual-band planar three-port antenna manufactured on a printed circuit substrate in accordance with one or more embodiments of the invention.

Another example of an antenna designed to operate in two frequency bands is shown in FIG. 4. This antenna 400 has the same basic structure as that of the antenna 200 of FIG. 2, with the salient difference being that each of the elements 402, 404, and 406 has branched ends. In this embodiment, the lengths of the branches have been optimized to align the frequencies of operation with the WLAN bands within 2.4 to 2.5 GHz and 5.15 to 5.85 GHz. The lengths of the inner branches primarily dictate the frequency of the upper band (5 GHz), while the lengths of the outer branches dictate the frequency of the lower band (2.4 GHz). The size of the elements 402, 404, and 406 is such that the outer vertices fall on a circle with a radius of 26 mm.

The dielectric material in this example is cut to a hexagonal shape instead of circular shape. Any shape that maintains regular three-fold symmetry is suitable for maintaining equal performance from all three antenna ports. Because the effect of the dielectric is small, using a shape without this symmetry, e.g., square or rectangular, may also provide acceptable performance in most applications.

Figure 5A:
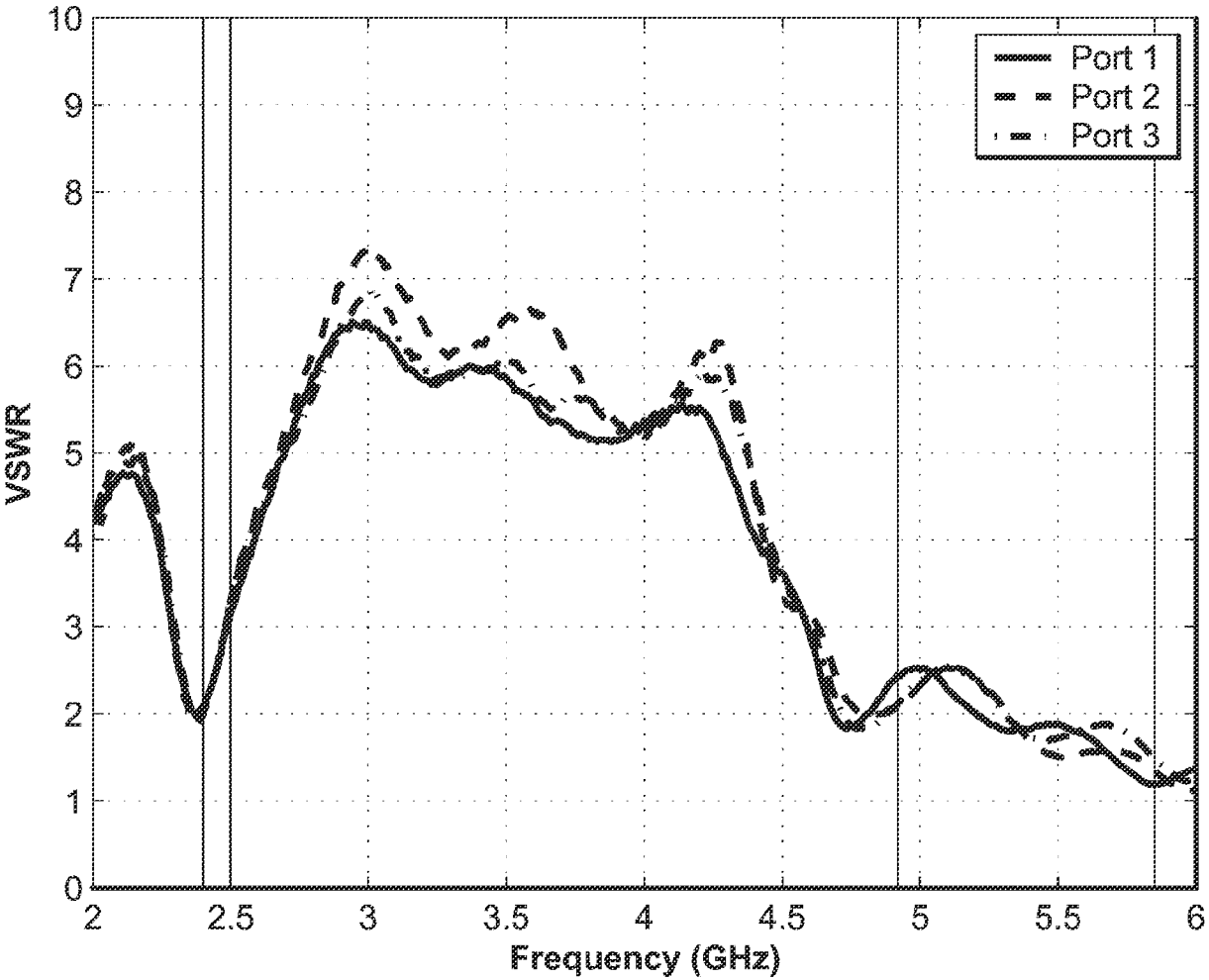
FIG. 5A is a graph illustrating the VSWR of the antenna of FIG. 4.
Figure 5B:
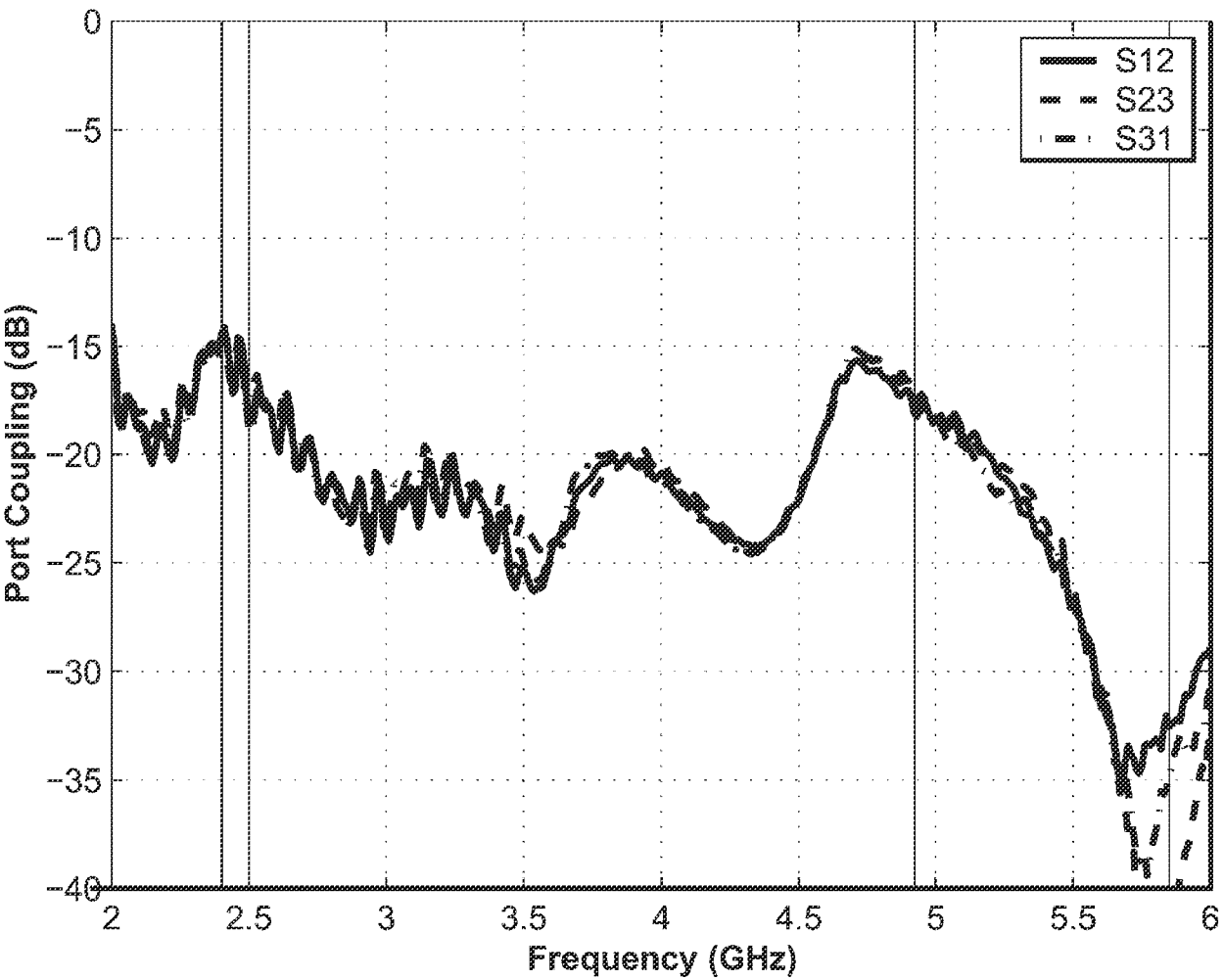
FIG. 5B is a graph illustrating the port to port coupling (S12) for the antenna of FIG. 4.

Graphs of the measured VSWR and S21 for the antenna 400 of FIG. 4 are shown in FIGS. 5A and 5B, respectively. For this design, the desired input impedance was obtained by selection of the port locations and the gap between the conductive elements, and no discrete matching components are used.

Figure 5C:
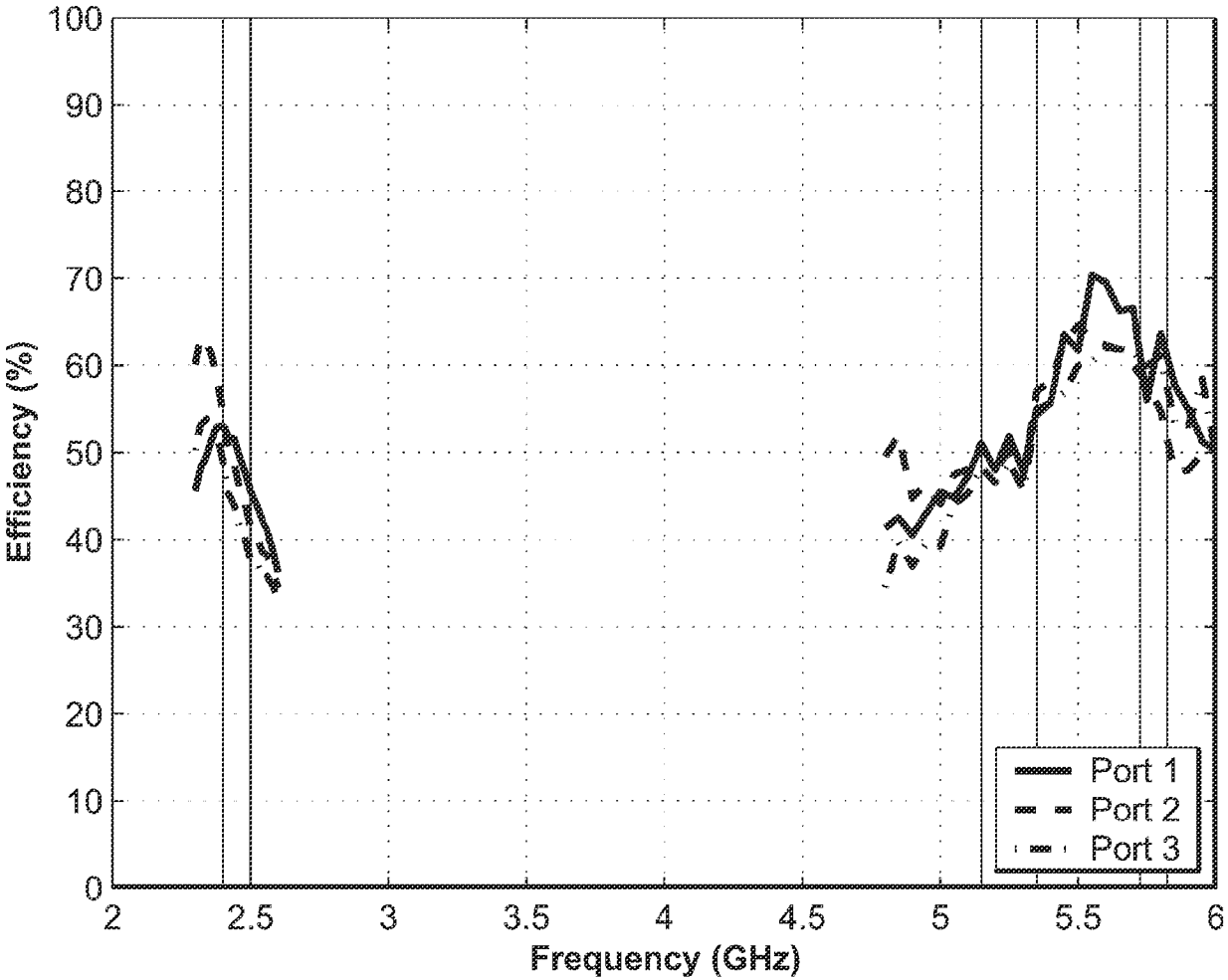
FIG. 5C is a graph illustrating the of the radiation efficiency for the antenna of FIG. 4.
Figure 5D:
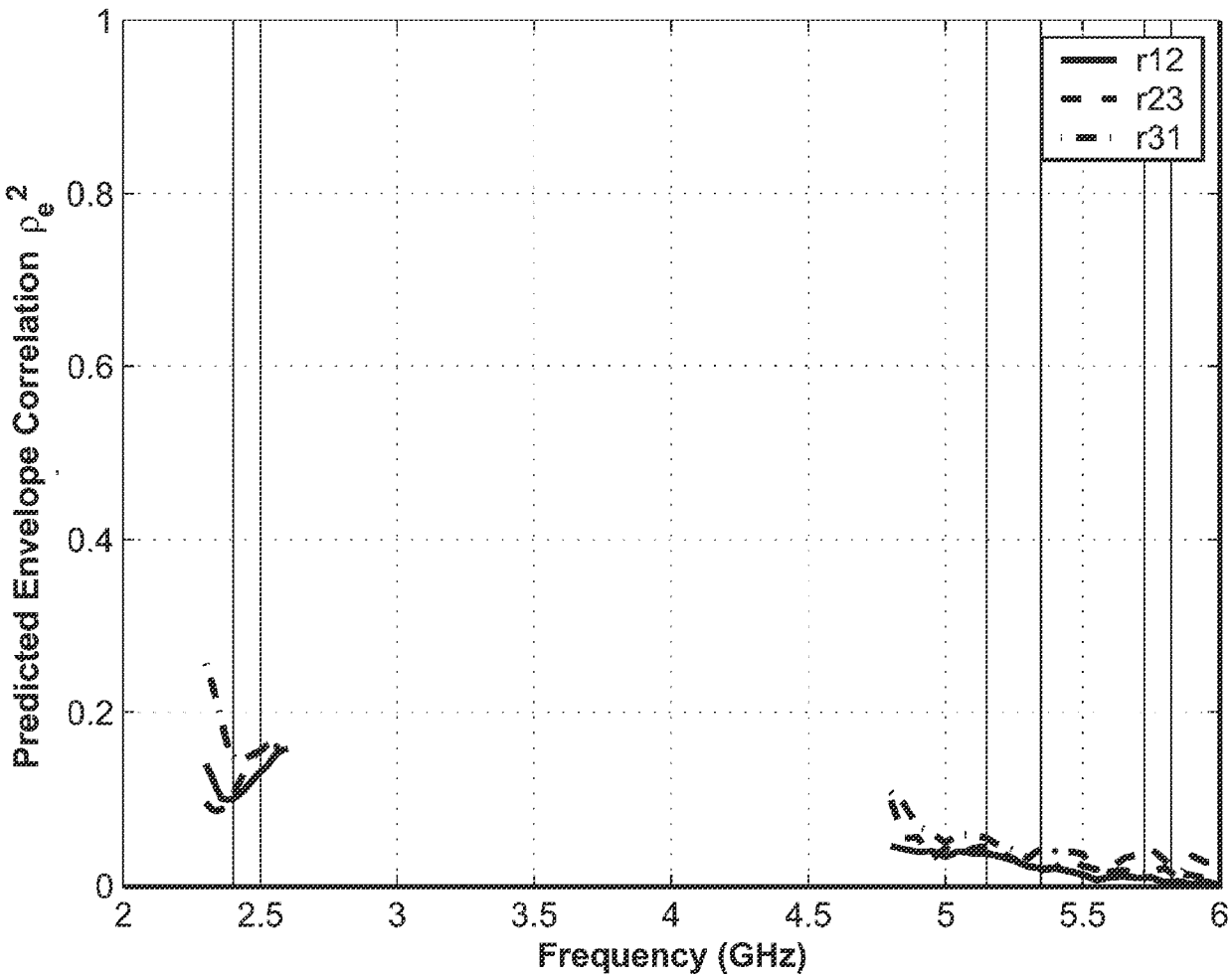
FIG. 5D is a graph illustrating the square of the pattern correlation coefficients for the antenna of FIG. 4.
Figure 5E:
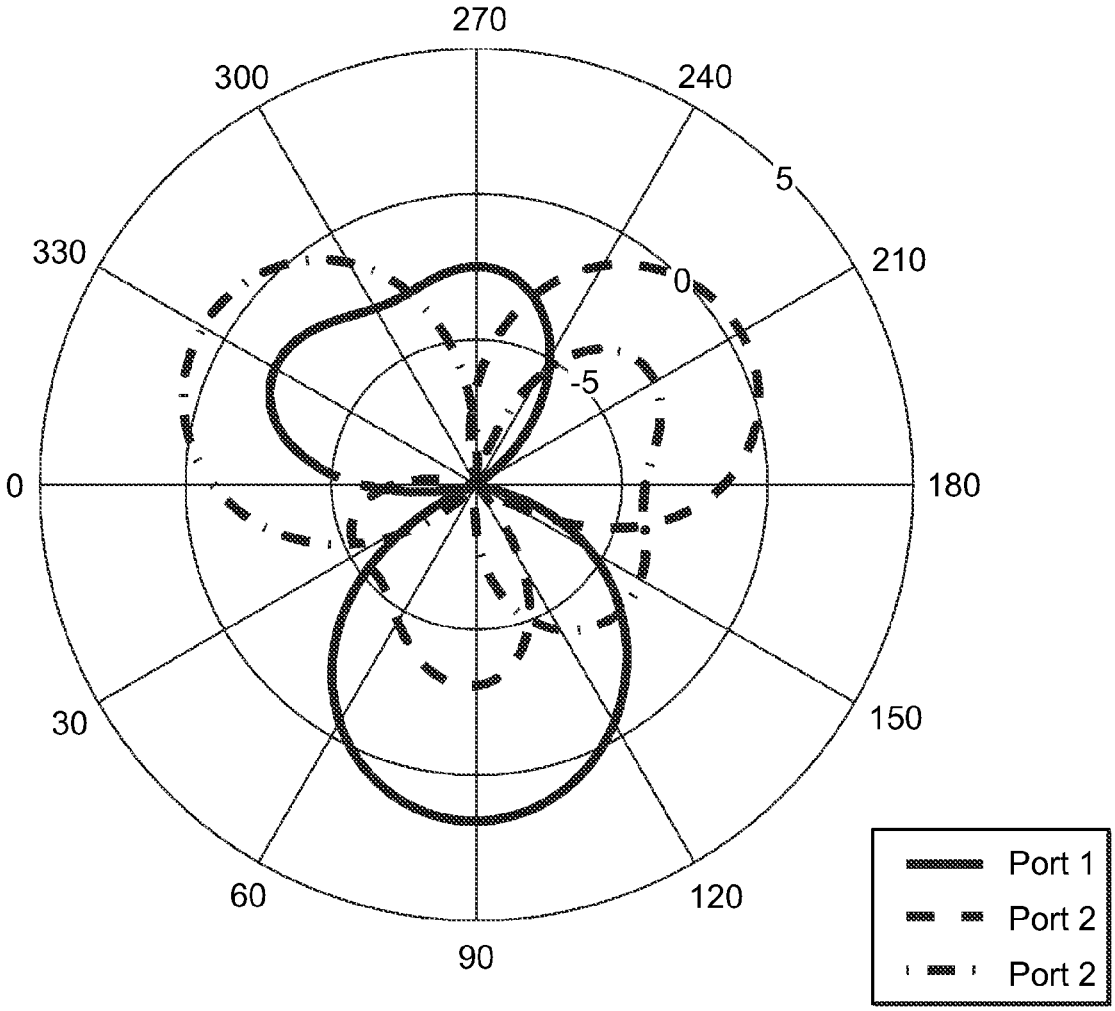
FIG. 5E is a graph illustrating the azimuthal gain plots for the antenna of FIG. 4 at a frequency of 2440 MHz.
Figure 5F:
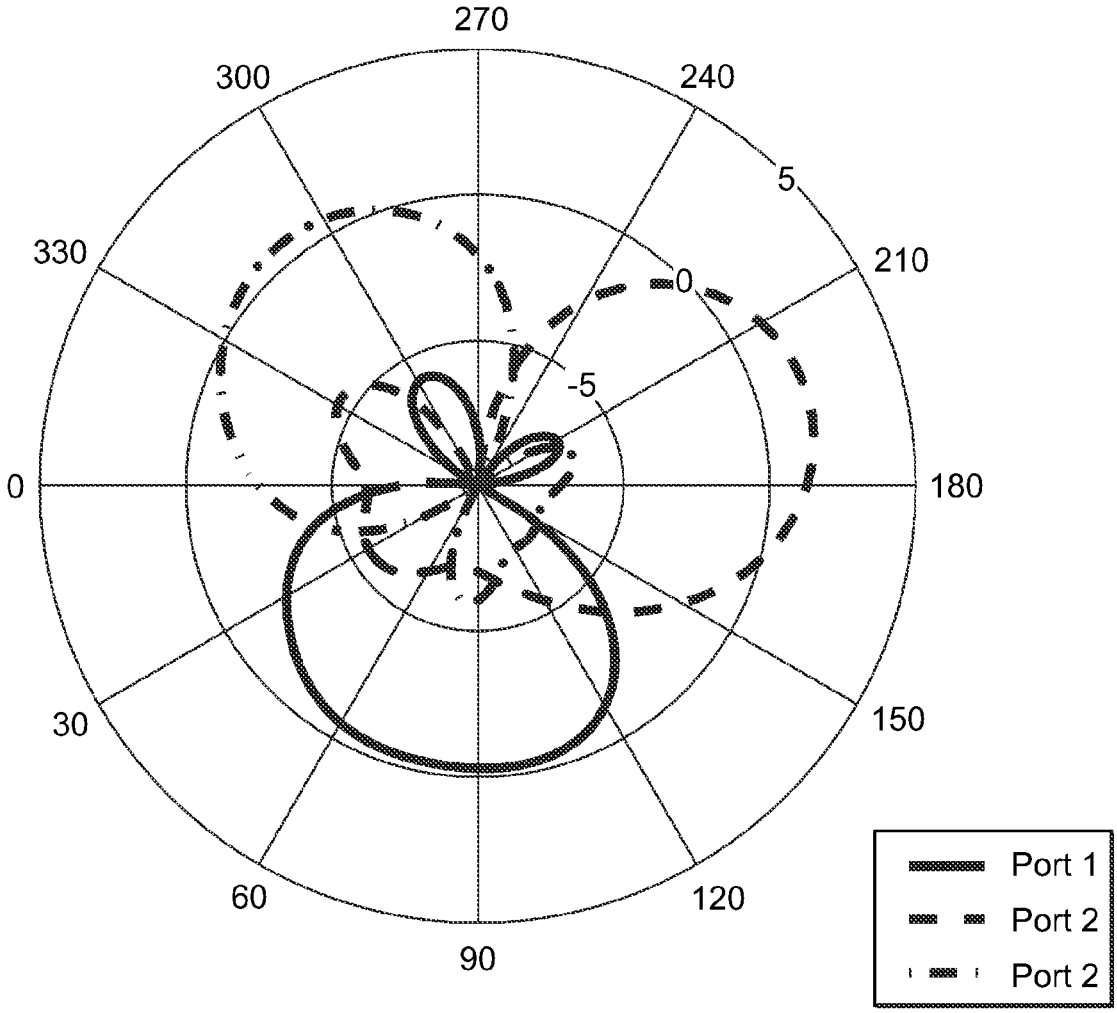
FIG. 5F is a graph illustrating the azimuthal gain plots for the antenna of FIG. 4 at a frequency of 5250 MHz.

The measured gain patterns on the azimuth plane are provided as FIGS. 5E and 5F for the frequencies of 2440 MHz and 5250 MHz. The pattern produced from excitation of Port 1 is similar to a dipole on the x-axis at 2440 MHz, while at 5250 MHz the pattern is more directional. By symmetry, the other two ports produce the same patterns, but rotated 120 or 240 degrees about the z-axis. These plots exhibit the angular orientation of each pattern. The correlation between the patterns produced by any two ports is low as shown on FIG. 5D. The measured realized efficiency is about 50 percent as shown on FIG. 5C.

While examples above illustrate an antenna with three electrically conductive elements and three antenna ports, it should be understood that an antenna embodying the features described herein can include any number of electrically conductive elements and antenna ports. In particular, in accordance with some embodiments, antennas with two or more electrically conductive elements and antenna ports are contemplated where the elements and ports are symmetrically arranged around a common axis, with the elements being bent such that the middle portion of each element is closer to the axis and the ends are further away from the axis, and the ports are connected across the gaps between pairs of adjacent conductive elements.

Additionally, while examples above illustrate antennas having electrically conductive elements lying in a common plane, it should be understood that an antenna embodying the features described herein can include electrically conductive elements lying in different planes. For example, in accordance with some embodiments, the electrically conductive elements of an antenna are symmetrically arranged around a common axis, but the ends of the elements are angled upward or downward from a plane normal to the axis.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Having described preferred embodiments of the present invention, it should be apparent that modifications can be made without departing from the spirit and scope of the invention.

What is claimed is:

1. A multi-port antenna structure, comprising:

a plurality of electrically conductive elements arranged generally symmetrically about a central axis with a gap between adjacent electrically conductive elements;

each of the electrically conductive elements having opposite ends and a bent middle portion therebetween, the bent middle portion being closer to the central axis than the opposite ends;

each of the electrically conductive elements being configured to have an electrical length selected to provide generally optimal operation within one or more selected frequency ranges; and a plurality of antenna ports, wherein each antenna port is connected to adjacent electrically conductive elements across the gap therebetween such that each antenna port is generally electrically isolated from another antenna port at a given desired signal frequency range and the antenna structure generates diverse antenna patterns.

2. The multi-port antenna of claim 1, wherein the plurality of electrically conductive elements comprises three electrically conductive elements.

3. The multi-port antenna of claim 1, wherein each of the electrically conductive elements has a planar structure.

4. The multi-port antenna of claim 1, wherein each of the electrically conductive elements has a wire-like structure.

5. The multi-port antenna of claim 1, wherein each of the electrically conductive elements includes additional ends extending from the middle portion.

6. The multi-port antenna of claim 5, wherein the length of each end of an electrically conductive element corresponds to a different half wavelength resonant frequency.

7. The multi-port antenna of claim 1, wherein each antenna port includes two terminals, and wherein a shield portion of a coaxial cable connected to radio circuitry is connected to one terminal and a center conductor of the coaxial cable is connected to the other terminal.

8. The multi-port antenna of claim 1, wherein the antenna structure further comprises a dielectric substrate on which each of the electrically conductive elements is formed.

9. The multi-port antenna of claim 1, wherein the dielectric substrate is circular or hexagonal shaped.

10. The multi-port antenna of claim 1, wherein the electrically conductive elements have an electrical length of about one half of the wavelength at a desired frequency of operation.

11. The multi-port antenna of claim 1, further comprising a plurality of impedance matching networks connected across the gaps between adjacent electrically conductive elements.

12. The multi-port antenna of claim 1, wherein the plurality of electrically conductive elements lie in a common plane, and wherein the central axis is perpendicular to the common plane.

13. The multimode antenna structure of claim 12, wherein the plurality of electrically conductive elements comprises three electrically conductive elements.

14. A multimode antenna structure for transmitting and receiving electromagnetic signals in a communications device, the communications device including circuitry for processing signals communicated to and from the antenna structure, the antenna structure comprising:

a plurality of electrically conductive elements lying in a common plane and arranged generally symmetrically about a central axis extending perpendicular to the common plane with a gap between adjacent electrically conductive elements;

each of the electrically conductive elements having opposite ends and a bent middle portion therebetween, the bent middle portion being closer to the central axis than the opposite ends;

each of the electrically conductive elements being configured to have an electrical length selected to provide generally optimal operation within one or more selected frequency ranges; and a plurality of antenna ports operatively coupled to the circuitry, wherein each antenna port is connected to adjacent electrically conductive elements across the gap therebetween such that an antenna mode excited by one antenna port is generally electrically isolated from a mode excited by another antenna port at a given desired signal frequency range and the antenna structure generates diverse antenna patterns.

15. The multimode antenna structure of claim 14, wherein each of the electrically conductive elements has a planar structure or a wire-like structure.

16. The multimode antenna structure of claim 14, wherein each of the electrically conductive elements includes additional ends extending from the middle portion.

17. The multimode antenna structure of claim 16, wherein the length of each end of an electrically conductive element corresponds to a different half wavelength resonant frequency.

18. The multimode antenna structure of claim 14, wherein each antenna port includes two terminals, and wherein a shield portion of a coaxial cable connected to radio circuitry is connected to one terminal and a center conductor of the coaxial cable is connected to the other terminal.

19. The multimode antenna structure of claim 14, wherein the electrically conductive elements have an electrical length of about one half of the wavelength at a desired frequency of operation.

20. The multimode antenna structure of claim 14, further comprising a plurality of impedance matching networks connected across the gaps between adjacent electrically conductive elements.

* * * * *